US010174431B2

(12) United States Patent
Sato et al.

(10) Patent No.: US 10,174,431 B2
(45) Date of Patent: Jan. 8, 2019

(54) ELECTROCHEMICAL REDUCTION DEVICE AND METHOD FOR MANUFACTURING HYDRIDE OF AROMATIC COMPOUND

(71) Applicant: JX NIPPON OIL & ENERGY CORPORATION, Chiyoda-ku, Tokyo (JP)

(72) Inventors: Yasushi Sato, Tokyo (JP); Kota Miyoshi, Tokyo (JP); Kojiro Nakagawa, Tokyo (JP); Yoshihiro Kobori, Tokyo (JP); Shinji Oshima, Tokyo (JP)

(73) Assignee: JXTG NIPPON OIL & ENERGY CORPORATION, Tokyo (JP)

( * ) Notice: Subject to any disclaimer, the term of this patent is extended or adjusted under 35 U.S.C. 154(b) by 282 days.

(21) Appl. No.: 15/008,870

(22) Filed: Jan. 28, 2016

(65) Prior Publication Data

US 2016/0145751 A1 May 26, 2016

Related U.S. Application Data

(63) Continuation of application No. PCT/JP2014/003883, filed on Jul. 23, 2014.

(30) Foreign Application Priority Data

Jul. 30, 2013 (JP) ..... 2013-158129

(51) Int. Cl.
*C25B 3/04* (2006.01)
*C25B 9/08* (2006.01)
*C25B 15/02* (2006.01)

(52) U.S. Cl.
CPC ..... *C25B 3/04* (2013.01); *C25B 9/08* (2013.01); *C25B 15/02* (2013.01)

(58) Field of Classification Search
CPC ..... C25B 3/04; C25B 15/02
See application file for complete search history.

(56) References Cited

U.S. PATENT DOCUMENTS

| | | | |
|---|---|---|---|
| 2,477,580 | A | 8/1949 | Condit |
| 2013/0313127 | A1 | 11/2013 | Sato et al. |
| 2016/0010223 | A1 | 1/2016 | Sato et al. |

FOREIGN PATENT DOCUMENTS

| | | | |
|---|---|---|---|
| JP | 08-246177 | A | 9/1996 |
| JP | 09-184086 | A | 7/1997 |

(Continued)

OTHER PUBLICATIONS

Extended European Search Report dated Jan. 18, 2017, issued by the European Patent Office in corresponding European Application No. 14832881.8. (10 pages).

(Continued)

*Primary Examiner* — Nicholas A Smith
(74) *Attorney, Agent, or Firm* — Buchanan Ingersoll & Rooney PC

(57) ABSTRACT

An electrochemical reduction device includes an electrode unit, a power control unit, a concentration measurement unit, and a control unit. The electrode unit includes an electrolyte membrane, a reduction electrode, and an oxygen evolving electrode. The control unit controls the power control unit such that a current value I flowing through the reduction electrode and the oxygen evolving electrode satisfies Equation, I≤Imax (C). In Equation, a maximum current value Imax (C) is defined according to a concentration C of an aromatic compound obtained by the concentration measurement unit such that Faraday efficiency is to be a predetermined value or more.

5 Claims, 6 Drawing Sheets

(56) References Cited

FOREIGN PATENT DOCUMENTS

| | | | |
|---|---|---|---|
| JP | 2003-45449 | A | 2/2003 |
| JP | 2005-126288 | A | 5/2005 |
| JP | 2005-239479 | A | 9/2005 |
| JP | 2011-174139 | A | 9/2011 |
| WO | 2011/122155 | A1 | 10/2011 |
| WO | 2012/015905 | A1 | 2/2012 |
| WO | 2012/091128 | A1 | 7/2012 |
| WO | 2014/156125 | A1 | 10/2014 |

OTHER PUBLICATIONS

Office Action dated Sep. 25, 2017, issued by the European Patent Office in corresponding European Application No. 14 832 881.8-1360 (5 pages).

International Preliminary Report on Patentability (Form PCT/IB/373) and Written Opinion of the International Searching Authority (Form PCT/IB/237) dated Feb. 2, 2016, by the International Bureau of WIPO in corresponding International Application No. PCT/JP2014/003883. (9 pgs).

International Search Report (Form PCT/ISA/210) dated Sep. 2, 2014, by the Japanese Patent Office in corresponding International Application No. PCT/JP2014/003883. (7 pgs).

Ichikawa, M "Novel Infra-Structured Technology of Hydrogen Transportation, Present Status and Future Problems", Journal of the Japan Institute of Energy vol. 85, Issue 7, pp. 517-524, Jun. 2006.

ELECTROCHEMICAL REDUCTION DEVICE AND METHOD FOR MANUFACTURING HYDRIDE OF AROMATIC COMPOUND

BACKGROUND OF THE INVENTION

1. Field of the Invention

The present invention relates to a technique for electrochemically hydrogenating an aromatic compound.

2. Description of the Related Art

It is known that a cyclic organic compound such as cyclohexane or decalin is efficiently obtained by hydrogenating a benzene ring of a corresponding aromatic hydrocarbon compound (benzene or naphthalene) using a hydrogen gas. This reaction requires reaction conditions of high temperature and high pressure, and thus is unsuitable for small to medium scale manufacturing a cyclic organic compound. On the other hand, in an electrochemical reaction using an electrolysis cell, it is not necessary to treat gaseous hydrogen since water can be used as a source of hydrogen, and also the reaction is known to proceed under relatively mild reaction conditions (at from room temperature to about 200° C. and under normal pressure).

[Patent document No. 1] JP 2003-045449

[Patent document No. 2] JP 2005-126288

[Patent document No. 3] JP 2005-239479

[non-patent document No. 1] Masaru Ichikawa, J. Jpn. Inst. Energy, vol. 85, 517 (2006)

As an example of electrochemically hydrogenating a benzene ring of an aromatic hydrocarbon compound such as toluene, a method has been reported in which toluene that is vaporized into a gaseous state is sent to the reduction electrode side to obtain methylcyclohexane, in which a benzene ring is hydrogenated, without going a state of a hydrogen gas, in a configuration similar to that of water electrolysis (see Masaru Ichikawa, J. Jpn. Inst. Energy, vol. 85, 517 (2006)). However, the amount of substance that can be transformed per electrode area or time (current density) is not large, and it has been difficult to industrially hydrogenate a benzene ring of an aromatic hydrocarbon compound.

As a method for improving the above-problems, the present inventors have examined a way for directly introducing an aromatic hydrocarbon compound in the liquid form to a reduction electrode side of electrolysis cell. In this case, as compared with a method of introducing a vaporized aromatic hydrocarbon compound, the above-described way allows an electrolytic hydrogenation reaction in a high current density to be performed. However, for such a way, when the current density exceeds any value, the electrolytic hydrogenation reaction and the hydrogen generation reaction are competed, and thereby, there is a problem in that Faraday efficiency that is a yield of electrolytic hydride per the quantity of flowing electricity decreases.

SUMMARY OF THE INVENTION

The present invention has been devised in view of the problem described above, and an object thereof is to provide a technique capable of high-optionally hydrogenating a benzene ring of an aromatic compound by an electrochemical reaction with high efficiency.

An embodiment of the present invention relates to an electrochemical reduction device. The electrochemical reduction device includes: an electrode unit being configured by including an electrolyte membrane having ionic conductivity, a reduction electrode that is provided on one side of the electrolyte membrane and includes an reduction catalyst for hydrogenating a benzene ring of an aromatic compound, and an oxygen evolving electrode that is provided on the other side of the electrolyte membrane; a power control unit that applies voltage Va to one electrode of the reduction electrode and the oxygen evolving electrode so as to produce an electric difference with respect to other electrode thereof; a concentration measurement unit that measures a concentration of the aromatic compound supplied to the reduction electrode; and a control unit that controls the power control unit such that a current value I flowing through the reduction electrode and the oxygen evolving electrode satisfies a relation of $I \leq Imax$ (C) with respect to a maximum current value Imax (C) defined according to the concentration C of the aromatic compound obtained by the concentration measurement unit; wherein the maximum current value Imax (C) is defined such that Faraday efficiency becomes a predetermined value or more.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

An embodiment of the present invention relates to an electrochemical reduction device. The electrochemical reduction device includes: an electrode unit being configured by including an electrolyte membrane having ionic conductivity, a reduction electrode that is provided on one side of the electrolyte membrane and includes an reduction catalyst for hydrogenating a benzene ring of an aromatic compound, and an oxygen evolving electrode that is provided on the other side of the electrolyte membrane; a power control unit that applies voltage Va to one electrode of the reduction electrode and the oxygen evolving electrode so as to produce an electric difference with respect to other electrode thereof; a concentration measurement unit that measures a concentration of the aromatic compound supplied to the reduction electrode; and a control unit that controls the power control unit such that a current value I flowing through the reduction electrode and the oxygen evolving electrode satisfies a relation of $I \leq Imax$ (C) with respect to a maximum current value Imax (C) defined according to the concentration C of the aromatic compound obtained by the concentration measurement unit; wherein the maximum current value Imax (C) is defined such that Faraday efficiency becomes a predetermined value or more.

In the electrochemical reduction device according to the embodiment, the maximum current value Imax (C) may be set to be low as the concentration C of the aromatic compound is low. In addition, the predetermined value may be 80%.

Another embodiment of the present invention relates to a method for manufacturing a hydride (or hydrogenated form) of an aromatic compound. The method for manufacturing a hydride of an aromatic compound includes: by using the electrochemical reduction device according to any one of the above embodiments, introducing an aromatic compound to the reduction electrode side of the electrode unit; and hydrogenating a benzene ring of the aromatic compound introduced to the reduction electrode side by flowing water or a humidified gas to the oxygen evolving unit side.

In the manufacturing method according to the embodiment, the aromatic compound introduced into the reduction electrode side may be introduced in a liquid state for a reaction temperature.

Hereinafter, the embodiments of the present invention will be described with reference to the drawings. In addition, in all the figures, like numerals represent like constituting elements and the description thereof will not be appropriately provided.

Embodiment 1

Figure 1:
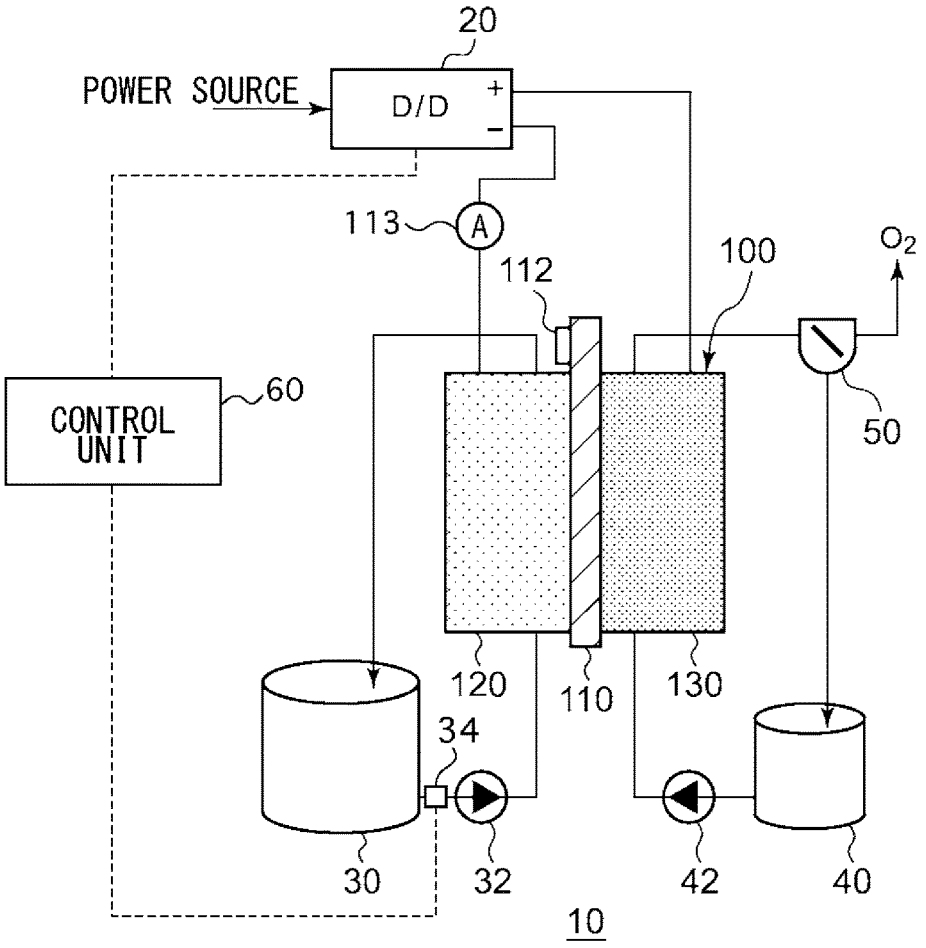
FIG. 1 is a schematic diagram illustrating the general configuration of an electrochemical reduction device according to an embodiment 1.
Figure 2:
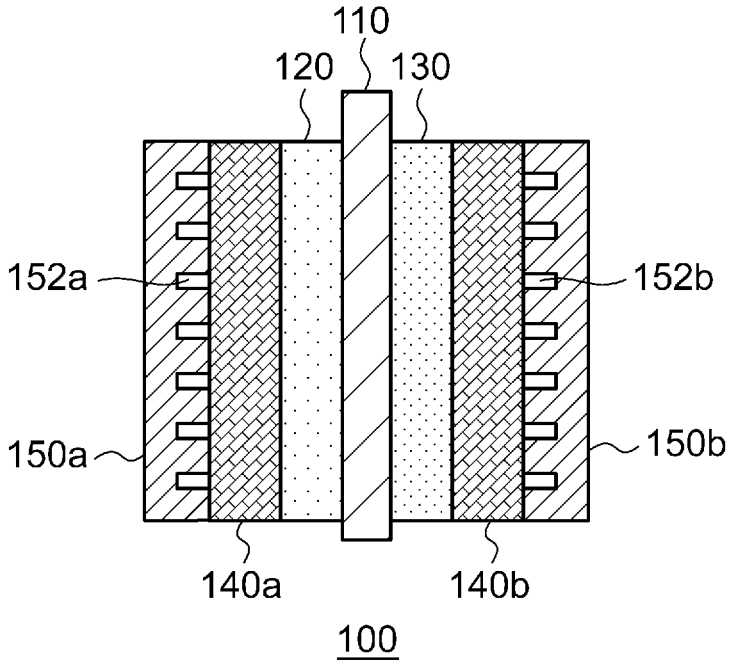
FIG. 2 is a diagram illustrating the general configuration of an electrode unit included in the electrochemical reduction device according to the embodiment 1.

FIG. 1 is a schematic diagram illustrating the general configuration of an electrochemical reduction device 10 according to an embodiment. FIG. 2 is a diagram illustrating the general configuration of an electrode unit included in the electrochemical reduction device 10 according to the embodiment. As illustrated in FIG. 1, the electrochemical reduction device 10 includes an electrode unit 100, a power control unit 20, an organic material storage tank 30, a concentration measurement unit 34, a water storage tank 40, a gas-water separation unit 50, and a control unit 60. As illustrated in FIG. 2, the electrode unit 100 includes an electrolyte membrane 110, a reduction electrode 120, an oxygen evolving electrode 130, liquid diffusion layers 140*a* and 140*b*, and separators 150*a* and 150*b*. Hereinafter, the combination of the electrolyte membrane 110, the reduction electrode 120, the oxygen evolving electrode 130, the liquid diffusion layers 140*a* and 140*b*, and the separators 150*a* and 150*b* is called a "cell".

The power control unit 20 is, for example, a DC/DC converter for converting the output voltage of a power source into a predetermined voltage. The positive electrode output terminal of the power control unit 20 is connected to the oxygen evolving electrode (positive electrode) 130 of the electrode unit 100. The negative electrode output terminal of the power control unit 20 is connected to the reduction electrode (negative electrode) 120 of the electrode unit 100. With this configuration, a predetermined voltage is applied between the oxygen evolving electrode 130 and the reduction electrode 120 of the electrode unit 100. In addition, a reference electrode may be provided to the power control unit 20 with the object of potential detection of the positive electrode and negative electrode. In this case, a reference electrode input terminal is connected to a reference electrode 112, which is described later, provided on the electrolyte membrane 110. The outputs of the positive electrode output terminal and the negative electrode output terminal of the power control unit 20 are controlled by the control unit 60 to be the desired potentials of the oxygen evolving electrode 130 and the reduction electrode 120 based on the potential of the reference electrode 112. In addition, as a power source, general system electric power may be used, and electric power derived from natural energy such as sunlight and wind power may be preferably used, but is not particularly limited thereto. The mode of the control of the current flowing through the oxygen evolving electrode 130 and the reduction electrode 120 by the control unit 60 will be described later.

The organic material storage tank 30 stores an aromatic compound. The aromatic compound used in the present embodiment is an aromatic hydrocarbon compound or a nitrogen-containing heterocyclic aromatic compound, which contains at least one aromatic ring, and examples thereof include benzene, naphthalene, anthracene, diphenylethane, pyridine, pyrimidine, pyrazine, quinoline, isoquinoline, N-alkylpyrrole, N-alkylindole, N-alkyldibenzopyrrole and the like. In addition, 1 to 4 hydrogen atoms of the aromatic ring of the aromatic hydrocarbon or nitrogen-containing heterocyclic aromatic compound described above may be substituted by an alkyl groups. It is to be noted that the "alkyl" of the aromatic compound is a linear or branched alkyl group having 1 to 6 carbon atoms. For example, alkylbenzenes include toluene, ethyl benzene and the like, dialkylbenzenes include xylene, diethylbenzene and the like, and trialkylbenzenes include mesitylene and the like. Alkylnaphthalenes include methylnaphthalene and the like. In addition, the aromatic ring of the aromatic hydrocarbon or nitrogen-containing heterocyclic aromatic compound described above may have 1 to 3 substituents. In the specification to be described below, the aromatic hydrocarbon compound and the nitrogen-containing heterocyclic aromatic compound used in the present invention are referred to as "aromatic compounds" in some cases. The aromatic compound is preferably a liquid at room temperature. When a mixture of two or more of the above-described aromatic compounds is used, the mixture may be a liquid. Consequently, the aromatic compound can be supplied to the electrode unit 100 in a liquid state without performing processes such as heating and pressurizing, so that the configuration of the electrochemical reduction device 10 can be simplified. The concentration of the aromatic hydrocarbon compound in a state of liquid is 0.1% or more, preferably 0.3% or more, and more preferably 0.5% or more.

The aromatic compound stored in the organic material storage tank 30 is supplied to the reduction electrode 120 of the electrode unit 100 by a first liquid supply device 32. For the first liquid supply device 32, for example, various types of pumps such as a gear pump or a cylinder pump, or a gravity flow device or the like may be used. Instead of the aromatic compound, an N-substitution product of the above-described aromatic compound may be used. A circulation pathway is provided between the organic material storage tank 30 and the reduction electrode 120 of the electrode unit 100. The aromatic compound that is nucleus-hydrogenated by the electrode unit 100 and an unreacted aromatic compound pass through the circulation pathway and are stored in the organic material storage tank 30. No gas is generated by a major reaction that proceeds at the reduction electrode 120 of the electrode unit 100, but when gas is additionally generated, a gas-liquid separation device may be provided in the middle of the circulation pathway.

The concentration measurement unit 34 measures the concentration of the aromatic compound in the organic liquid to be supplied to the reduction electrode 120 of the electrode unit 100. The concentration of the aromatic compound measured by the concentration measurement unit 34 is sent to the control unit 60. In this embodiment, the concentration measurement unit 34 is provided on the front of the reduction electrode 120 of the electrode unit 100 (in this embodiment, between the first liquid supply device 32 and the organic material storage tank 30), but may be provided on everywhere in the circulation pathway of the aromatic compound. When the concentration measurement unit 34 is provided on the front of the reduction electrode 120 of the electrode unit 100, from then on, the concentration of the aromatic compound to be treated in the electrode unit 100 is measured. When the concentration measurement unit 34 is provided on the outlet side of the reduction electrode 120 of the electrode unit 100, since the aromatic compound is consumed as much as the quantity of electricity flowing through the reduction electrode 120 of the electrode unit 100, the concentration of the aromatic compound in the organic liquid to be supplied to the reduction electrode 120 of the electrode unit 100 can be obtained through the revision to add the quantity of the consumption to the measured concentration.

As the concentration measurement unit 34, for example, there may be a method for measuring in an in-line (in real time) a concentration of an aromatic compound by an optical detection device, or a device for sensing a change of dielectric constant, and a method for measuring in an off-line (in non-real time) a concentration of an aromatic compound.

As the optical detection device, there may be a method using a difference between the optical properties of an aromatic compound as a raw material and a hydrogen-attached compound as a product. For example, in general, an aromatic compound has a strong absorption region at an UV region (254 nm). Therefore, the concentration of an aromatic compound can be calculated from a predetermined calibration curve by calculating absorbance from the intensity of light transmitted by the irradiation of the light with the wavelength near the UV region. For this object, it is preferable that a part of the pipeline be nearly transparent at a measurement wavelength in order to use the part of the pipeline for supplying or circulating the aromatic compound for the corresponding optical detection. In addition to the UV absorption, for example, a method for converting a refractive index obtained by measuring a refractive index of an organic liquid circulating the pipeline into the concentration of an aromatic compound may be used.

As the device to accurately calculate a concentration of an aromatic compound in an off-line in a high degree of precision, a method using an analyzer such as a gas chromatography (GC), a liquid chromatography (LC), and a mass spectrum (MS) may be used. The concentration of the aromatic compound can be measured by measuring the aromatic compound using such an analyzer after sampling the organic liquid from the inside of a pipeline for supplying the aromatic compound to the reduction electrode 120 or an organic material storage tank 30. In this case, an autosampler may be used for sampling an organic liquid from the inside of the pipeline or the organic material storage tank 30 on a regular cycle. In addition, GC and LC may be used with MS.

The water storage tank 40 stores ion-exchanged water, purified water, an aqueous solution prepared by adding sulfuric acid thereto, and the like (hereinafter, simply referred to as "water"). Water stored in the water storage tank 40 is supplied to the oxygen evolving electrode 130 of the electrode unit 100 by a second liquid supply device 42. For the second liquid supply device 42, for example, various types of pumps such as a gear pump or a cylinder pump or a gravity flow device or the like can be used as in the case of the first liquid supply device 32. A circulation pathway is provided between the water storage tank 40 and the oxygen evolving electrode 130 of the electrode unit 100, and water that is unreacted in the electrode unit 100 passes through the circulation pathway and is stored in the water storage tank 40. The gas-water separation unit 50 is provided in the middle of a pathway where unreacted water is sent back to the water storage tank 40 from the electrode unit 100. By the gas-water separation unit 50, oxygen evolved by the electrolysis of water in the electrode unit 100 is separated from water and discharged to outside the system.

The cell that comprises the electrode unit 100 may be one or more. When the electrode unit 100 is comprised by a plurality of cells, voltage applied between the positive electrode output terminal and negative electrode output terminal of the power control unit 20 may be determined so that the desired voltage Va is applied to each cell. In FIG. 1, the electrode unit 100 is simplified for illustration, and liquid diffusion layers 140*a* and 140*b* and separators 150*a* and 150*b* are not illustrated.

The electrolyte membrane 110 is formed of a material (ionomer) having protonic conductivity, and inhibits substances from getting mixed or being diffused between the reduction electrode 120 and the oxygen evolving electrode 130 while selectively conducting protons. The thickness of the electrolyte membrane 110 is preferably from 5 to 300 μm, more preferably from 10 to 150 μm, and most preferably from 20 to 100 μm. If the thickness of the electrolyte membrane 110 is less than 5 μm, the barrier property of the electrolyte membrane 110 is deteriorated, so that cross-leaking easily occurs. If the thickness of the electrolyte membrane 110 is more than 300 μm, ion transfer resistance becomes too large, and thus the thickness of more than 300 μm is not preferred.

The area specific resistance, that is, ion transfer resistance per geometric area, of the electrolyte membrane 110 is preferably 2000 $m\Omega\cdot cm^2$ or less, more preferably 1000 $m\Omega\cdot cm^2$ or less, and most preferably 500 $m\Omega\cdot cm^2$ or less. If the area specific resistance of the electrolyte membrane 110 is more than 2000 $m\Omega\cdot cm^2$, protonic conductivity becomes insufficient. Examples of the material having protonic conductivity (which is a cation-exchanging ionomer) include perfluorosulfonic acid polymers such as Nafion (registered trademark) and Flemion (registered trademark). The ion exchange capacity (IEC) of the cation-exchanging ionomer is preferably from 0.7 to 2 meq/g, and more preferably from 1 to 1.2 meq/g. If the ion exchange capacity of the cation-exchanging ionomer is less than 0.7 meq/g, ionic conductivity becomes insufficient. On the other hand, if the ion exchange capacity of the cation-exchanging ionomer is more than 2 meq/g, the solubility of the ionomer in water is increased, so that the strength of the electrolyte membrane 110 becomes insufficient.

On the electrolyte membrane 110, a reference electrode 112 may be provided in an area spaced apart from the reduction electrode 120 and the oxygen evolving electrode 130 in such a manner that the reference electrode 112 is in contact with the electrolyte membrane 110. In other words, the reference electrode 112 is electrically isolated from the reduction electrode 120 and the oxygen evolving electrode 130. The reference electrode 112 is held at a reference electrode potential $V_{Ref}$. Examples of the reference electrode 112 include a standard hydrogen reduction electrode (reference electrode potential $V_{Ref}$=0 V) and an Ag/AgCl electrode (reference electrode potential $V_{Ref}$=0.199 V), but the reference electrode 112 is not limited thereto. In the case of providing the reference electrode 112, the reference electrode 112 is preferably provided on the surface of the electrolyte membrane 110 on the reduction electrode 120 side.

A current value I flowing through the reduction electrode 120 is detected by a current detection unit 113. The value of the current value I detected by the current detection unit 113 is input to the control unit 60.

The reduction electrode 120 is provided on one side of the electrolyte membrane 110. The reduction electrode 120 is a reduction electrode catalyst layer containing a reduction catalyst for hydrogenating a benzene ring of an aromatic compound. A reduction catalyst used for the reduction electrode 120 is not particularly limited, but includes, for example, at least one of Pt and Pd. In addition, the reduction catalyst may be composed of a metal composition which contains a first catalyst metal (noble metal) containing at least one of Pt and Pd, and one or two or more second catalyst metals selected from Cr, Mn, Fe, Co, Ni, Cu, Zn, Mo, Ru, Sn, W, Re, Pb, and Bi. In this case, the form of the metal composition is an alloy of the first catalyst metal and the second catalyst metal, or an intermetallic compound composed of the first catalyst metal and the second catalyst metal. The ratio of the first catalyst metal to the total mass of the first catalyst metal and the second catalyst metal is preferably from 10 to 95 wt %, more preferably from 20 to 90 wt %, and most preferably from 25 to 80 wt %. If the ratio of the first catalyst metal is less than 10 wt %, durability may be deteriorated from the perspective of resistance to dissolving or the like. On the other hand, if the ratio of the first catalyst metal is more than 95 wt %, the properties of the reduction catalyst become closer to those of a noble metal alone, and therefore the electrode activity becomes insufficient. In the following explanation, the first catalyst metal and the second catalyst metal are collectively referred to as "catalyst metals" in some cases.

The above-described catalyst metals may be supported by a conductive material (support). The electrical conductivity of the conductive material is preferably $1.0\times10^{-2}$ S/cm or more, more preferably $3.0\times10^{-2}$ S/cm or more, and most preferably $1.0\times10^{-1}$ S/cm or more. If the electrical conductivity of the conductive material is less than $1.0\times10^{-2}$ S/cm, sufficient conductivity cannot be imparted. Examples of the conductive material may include conductive materials containing any one of a porous carbon, a porous metal, and a porous metal oxide as a major component. Examples of the porous carbon may include carbon black such as Ketjen black (registered trademark), acetylene black, and Vulcan (registered trademark). The BET specific surface area of the porous carbon measured by a nitrogen adsorption method is preferably 100 $m^2/g$ or more, more preferably 150 $m^2/g$ or more, and most preferably 200 $m^2/g$ or more. If the BET specific surface area of the porous carbon is less than 100 $m^2/g$, it is difficult to uniformly support the catalyst metals. Therefore, the rate of utilization of a catalyst metal surface is lowered, causing catalyst performance to be degraded. Examples of the porous metal may include Pt black, Pd black, a Pt metal deposited in a fractal shape, and the like. Examples of the porous metal oxide include oxides of Ti, Zr, Nb, Mo, Hf, Ta and W. In addition, examples of the porous conductive material for supporting a catalyst metal include nitrides, carbides, oxynitrides, carbonitrides, partially-oxidized carbonitrides of metals such as Ti, Zr, Nb, Mo, Hf, Ta, and W (hereinafter, they are collectively referred to as porous metal carbonitrides and the like). The BET specific surface areas of the porous metal, the porous metal oxide, the porous metal carbonitrides and the like measured by a nitrogen adsorption method are preferably 1 $m^2/g$ or more, more preferably 3 $m^2/g$ or more, and most preferably 10 $m^2/g$ or more. If the respective BET specific surface areas of the porous metal, the porous metal oxide, the porous metal carbonitrides and the like is less than 1 $m^2/g$, it is difficult to uniformly support the catalyst metals. Therefore, the rate of utilization of a catalyst metal surface is lowered, causing catalyst performance to be degraded.

To the reduction electrode 120, a material having conductivity, such as the aforementioned conductive oxide or carbon black may be added in addition to a conductive compound on which a catalyst metal is supported. Consequently, the number of electron-conducting paths among reduction catalyst particles can be increased, and thus resistance per geometric area of a reduction catalyst layer can be lowered in some cases.

The reduction electrode 120 may include a fluorine-based resin such as polytetrafluoroethylene (PTFE) as an additive.

The reduction electrode 120 may contain an ionomer having protonic conductivity. The reduction electrode 120 preferably contains ionically conducting materials (ionomers) having a structure that is identical or similar to that of the above-described electrolyte membrane 110 in a predetermined mass ratio. This allows the ionic conductivity of the reduction electrode 120 to be improved. In particular, in the case where a catalyst support is porous, the reduction electrode 120 makes a significant contribution to the improvement of the ionic conductivity by containing an ionomer that has protonic conductivity. Examples of the ionomer having protonic conductivity (which is a cation-exchanging ionomer) include perfluorosulfonic acid polymers such as Nafion (registered trademark) and Flemion (registered trademark). The ion exchange capacity (IEC) of the cation-exchanging ionomer is preferably from 0.7 to 3 meq/g, more preferably from 1 to 2.5 meq/g, and most preferably from 1.2 to 2 meq/g. When the catalyst metal is supported on porous carbon (carbon support), a mass ratio I/C of the cation-exchanging ionomer (I) to the carbon support (C) is preferably from 0.1 to 2, more preferably from 0.2 to 1.5, and most preferably from 0.3 to 1.1. It is difficult to obtain sufficient ionic conductivity if the mass ratio I/C is less than 0.1. On the other hand, if the mass ratio I/C is more than 2, the thickness of an ionomer coating over the catalyst metal is increased to inhibit the aromatic compound as a reactant from contacting a catalyst-active site, or the electron conductivity is decreased to reduce the electrode activity.

Preferably, the ionomer contained in the reduction electrode 120 partially covers a reduction catalyst. This allows three elements (an aromatic compound, a proton, and an electron), which are necessary for an electrochemical reaction at the reduction electrode 120, to be efficiently supplied to a reaction sites.

The liquid diffusion layer **140*a* is laminated on the surface of the reduction electrode 120 on a side opposite to the electrolyte membrane 110. The liquid diffusion layer 140*a* plays a function of uniformly diffusing, to the reduction electrode 120, a liquid aromatic compound supplied from the separator 150*a*, which is described later. As the liquid diffusion layer 140*a***, for example, carbon paper or carbon cloth is used.

The separator **150*a* is laminated on the surface of the liquid diffusion layer 140*a* on a side opposite to the electrolyte membrane 110. The separator 150*a* is formed of a carbon resin, or an anticorrosion alloy of Cr—Ni—Fe, Cr—Ni—Mo—Fe, Cr—Mo—Nb—Ni, Cr—Mo—Fe—W—Ni or the like. One or more groove-like flow channels 152*a* are provided on the surface of the separator 150*a* on the liquid diffusion layer 140*a* side. The liquid aromatic compound supplied from the organic material storage tank 30 circulates through the flow channel 152***a*, and the liquid aromatic compound penetrates into the liquid diffusion layer 140*a* from the flow channel 152*a*. The form of the flow channel 152*a* is not particularly limited, but for example, a straight flow channel or a serpentine flow channel can be employed. When a metal material is used for the separator 150*a*, the separator 150*a* may be a structure formed by sintering a sphere-like or pellet-like metal fine powder.

The oxygen evolving electrode 130 is provided on the other side of the electrolyte membrane 110. As the oxygen evolving electrode 130, one that contains a catalyst based on a noble metal oxide such as $RuO_2$ or $IrO_2$ is suitably used. These catalysts may be supported in a dispersed manner or coated on a metal substrate such as a metal wire or mesh of metals such as Cr, Mn, Fe, Co, Ni, Cu, Zn, Nb, Mo, Ta, and W or of alloys composed primarily of these metals. In particular, since $IrO_2$ is expensive, manufacturing costs can be lowered by coating the metal substrate with a thin film when $IrO_2$ is used as a catalyst.

The liquid diffusion layer 140*b* is laminated on the surface of the oxygen evolving electrode 130 on a side opposite to the electrolyte membrane 110. The liquid diffusion layer 140*b* plays a function of uniformly diffusing, to the oxygen evolving electrode 130, water supplied from the separator 150*b*, which is described later. As the liquid diffusion layer 140*b*, for example, carbon paper or carbon cloth is used.

The separator 150*b* is laminated on the surface of the liquid diffusion layer 140*b* on a side opposite to the electrolyte membrane 110. The separator 150*b* is formed of an anticorrosion alloy of Cr/Ni/Fe, Cr/Ni/Mo/Fe, Cr/Mo/Nb/Ni, Cr/Mo/Fe/W/Ni, or the like or of a material formed by coating the surfaces of these metals with an oxide layer. One or more groove-like flow channels 152*b* are provided on the surface of the separator 150*b* on the liquid diffusion layer 140*b* side. Water supplied from the water storage tank 40 circulates through the flow channel 152*b*, and the water penetrates into the liquid diffusion layer 140*b* from the flow channel 152*b*. The form of the flow channel 152*b* is not particularly limited, but for example, a straight flow channel or a serpentine flow channel can be employed. When a metal material is used for the separator 150*b*, the separator 150*b* may be a structure formed by sintering a sphere-like or pellet-like metal fine powder.

In the present embodiment, liquid water is supplied to the oxygen evolving electrode 130, but a humidified gas (for example, air) may be used in place of the liquid water. In this case, the dew-point temperature of the humidified gas is preferably from room temperature to 100° C., and more preferably from 50 to 100° C.

When toluene is used as the aromatic compound, reactions in the electrode unit 100 are as follows.

$$3H_2O \rightarrow 1.5O_2 + 6H^+ + 6e^- \quad E_0 = 1.23\ V \quad \text{<Electrode Reaction at Oxygen Evolving Electrode>}$$

$$\text{toluene} + 6H^+ + 6e^- \rightarrow \text{methylcyclohexane}: E_0 = 0.153\ V \text{ (vs RHE)} \quad \text{<Electrode Reaction at Reduction Electrode>}$$

In other words, the electrode reaction at the oxygen evolving electrode 130 and the electrode reaction at the reduction electrode 120 proceed in parallel, and protons evolved by electrolysis of water are supplied to the reduction electrode 120 via the electrolyte membrane 110 in the electrode reaction at the oxygen evolving electrode 130, and used for hydrogenation of the benzene ring of the aromatic compound in the electrode reaction at the reduction electrode 120.

Here, a way at the core of the control by the control unit 60 will be described with reference to experimental data.

A cell configuration of the electrode unit used for the experiment is as follows.

Reduction electrode: 30 wt % of Pt-23.3 wt % of Ru/Carbon black electrode, 0.5 mg-Pt/cm$^2$, Ionomer (Nafion 2020CS)/Carbon ratio of 0.8

Electrolyte membrane: Nafion NR212CS (a thickness of 50 μm)

Oxygen evolving electrode: $IrO_2$ surface forming $TiO_2$ fiber electrode (a thickness of about 300 μm)

Under a condition of constant current density, the concentration of toluene supplied to the reduction electrode 120 was detected. In addition, the amount of material converted according to the change of toluene concentration was obtained by a gas chromatography, the quantity of electricity was obtained by a time integrating of current value time course by an electrochemical measuring device, and Faraday efficiency at each of the points was obtained by dividing the amount of material converted, by the quantity of electricity. Specifically, the central control values of current density were measured by being constant five conditions, that is, 50 mA/cm$^2$, 100 mA/cm$^2$, 200 mA/cm$^2$, 300 mA/cm$^2$, and 400 mA/cm$^2$.

Figure 3:
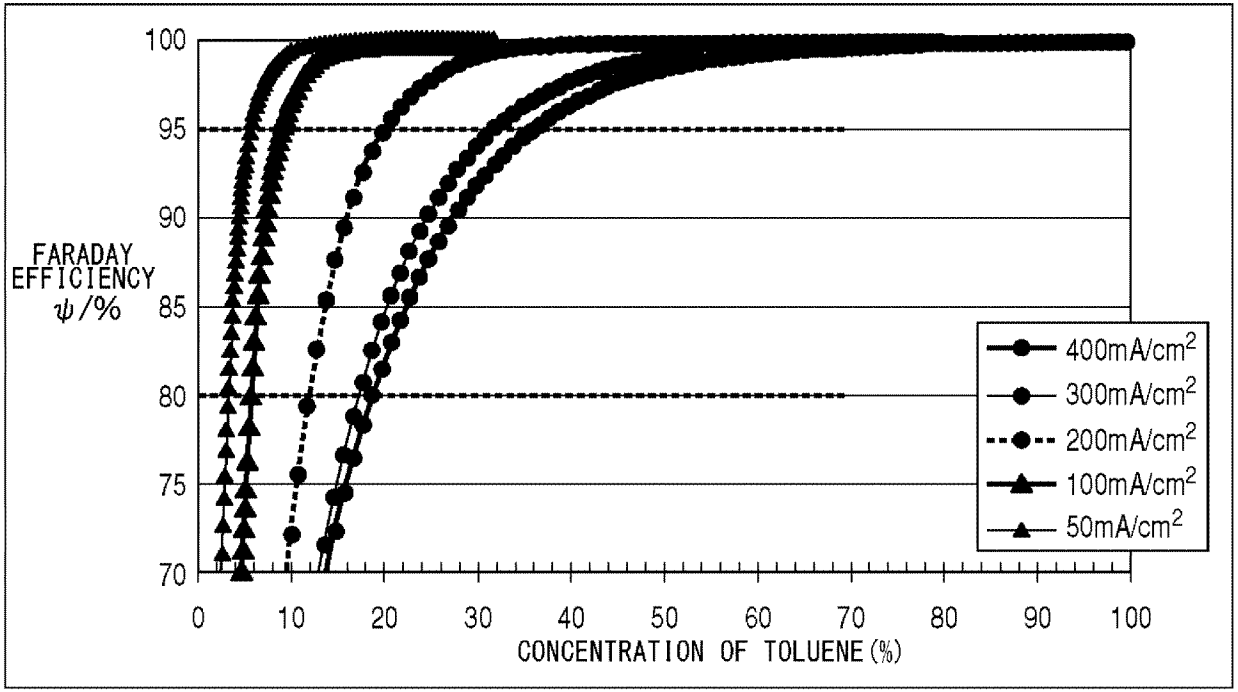
FIG. 3 is a graph illustrating the relation between a toluene concentration and Faraday efficiency under the condition of constant current density.
Figure 4:
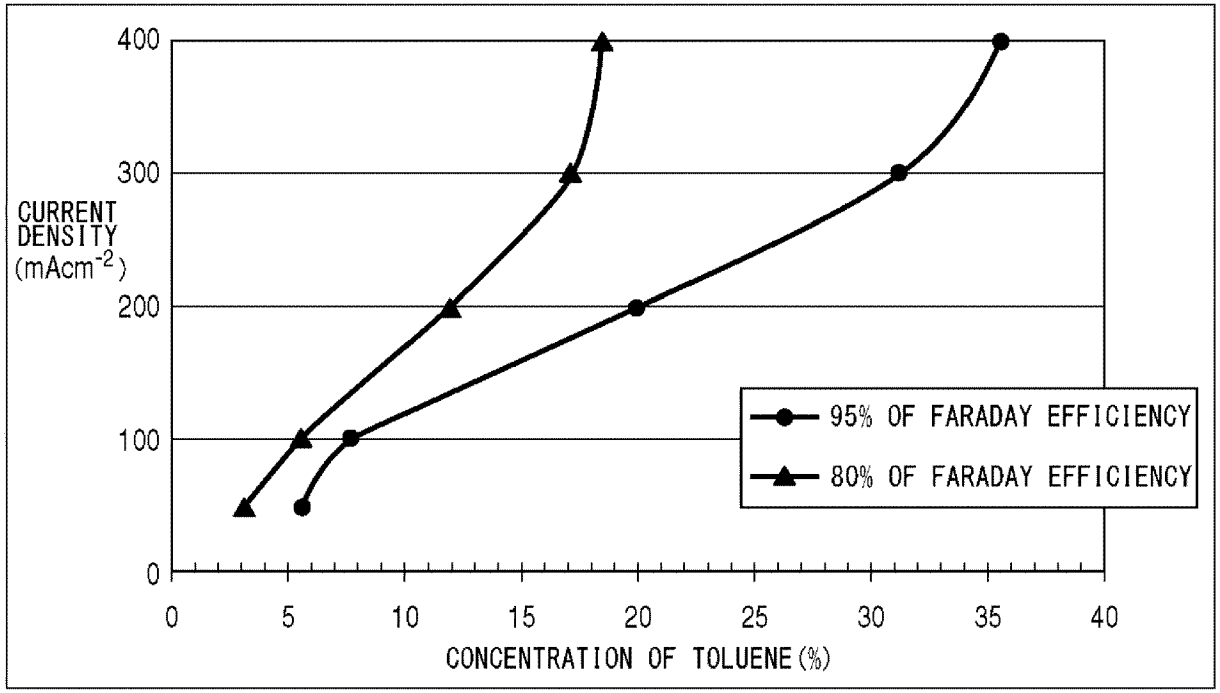
FIG. 4 is a graph illustrating the relations between the toluene concentration and current density when the Faraday efficiency is 80% and 95%.

FIG. 3 is a graph illustrating the relations between toluene concentrations and Faraday efficiencies under the conditions of constant current densities as the above-described values. As illustrated in FIG. 3, it is confirmed that the toluene concentrations are obtained to be Faraday efficiencies of 80% and 95% under the constant current densities as the above-described values. FIG. 4 is a graph illustrating the relations between the toluene concentration and current density when the Faraday efficiency is 80% and 95%. For example, in the case of any toluene concentration, when the current density is maintained to be equal to or less than the current density when the Faraday efficiency becomes 80%, it is possible to maintain Faraday efficiency of 80% or more. On the other hands, as the toluene concentration C becomes low, it is possible to maintain Faraday efficiency of 80% by decreasing the current density.

Based on this knowledge, the control unit 60 controls the power control unit 20 such that the current value I flowing through the reduction electrode 120 and the oxygen evolving electrode 130 satisfies the following Equation.

$$I \leq I\max(C)$$

In the above Equation, the maximum current value Imax (C) is determined according to the concentration C of the aromatic compound obtained in the concentration measurement unit 34 such that Faraday efficiency is to beat least 80% or more. For example, referring to FIG. 4, the relation represented by the line when Faraday efficiency becomes 80% is a function of the maximum current value Imax (C) for maintaining Faraday efficiency of 80% or more, and the maximum current value Imax (C) decreases as the concentration C of toluene decreases. When the desired Faraday efficiency exceeds 80%, for example, it is 95%, Imax (C) of Faraday efficiency of 95% is separately defined, and about this, when the control of I≤Imax (C) is performed, it is possible to maintain Faraday efficiency of 95% or more.

In addition, the following reaction conditions are used for the hydrogenation of at least of the benzene ring of the aromatic compound using the electrochemical reduction device 10. The temperature of the electrode unit 100 is preferably from room temperature to 100° C., and more preferably from 40 to 80° C. If the temperature of the electrode unit 100 is lower than room temperature, there is a concern that the proceeding of the electrolytic reaction may be slowed down, or an enormous amount of energy is required to remove heat generated as the reaction proceeds in order to maintain the temperature of the electrode unit 100 to be lower than room temperature, and thus not preferred. On the other hand, if the temperature of the electrode unit 100 is higher than 100° C., water is brought to a boil at the oxygen evolving electrode 130 and the vapor pressure of an organic material is increased at the reduction electrode 120, and thus the temperature higher than 100° C. is not preferred for the electrochemical reduction device 10 in which reactions of the both electrodes are performed in a liquid phase.

Figure 5:
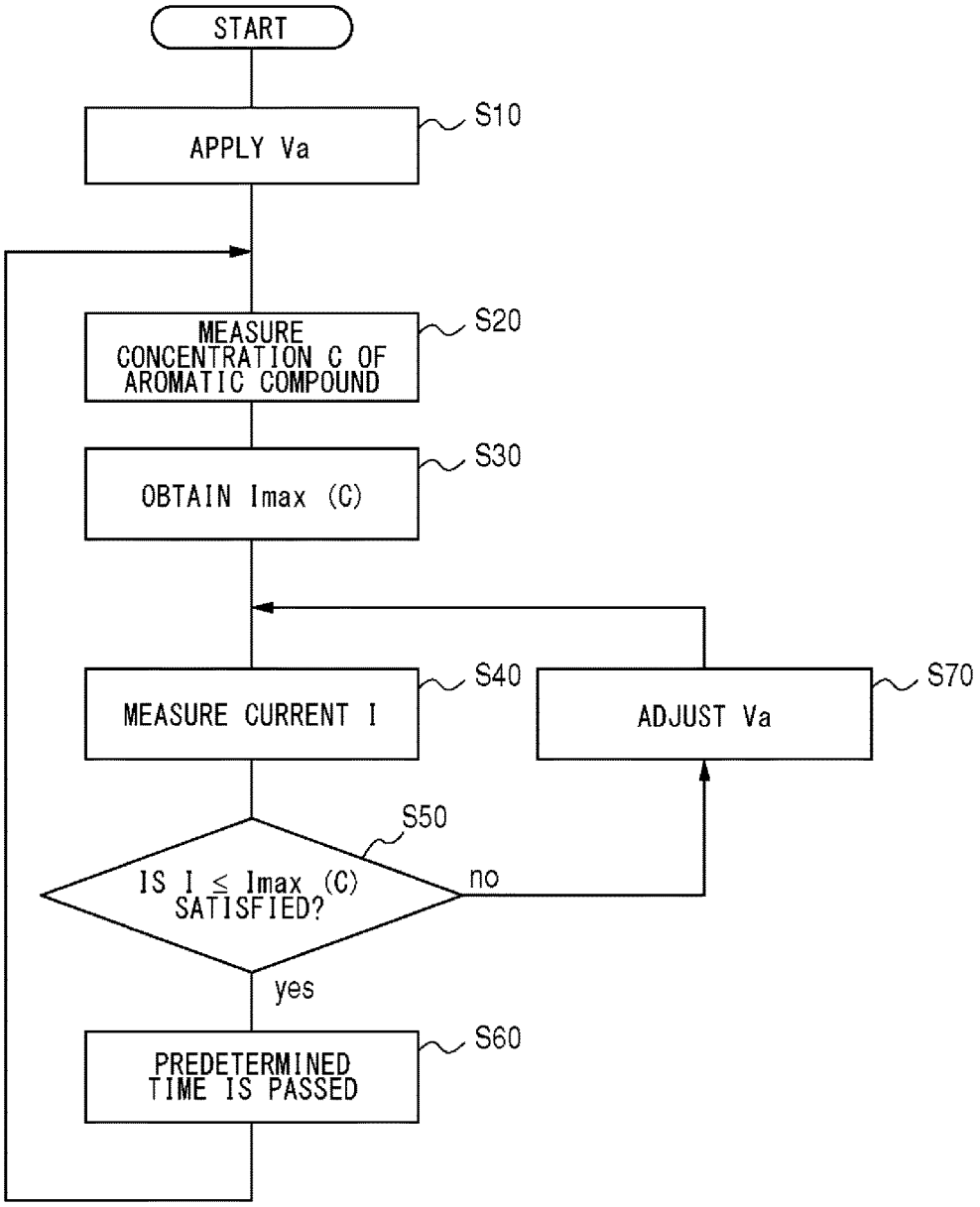
FIG. 5 is a flowchart illustrating an example of a current control by a control unit.

FIG. 5 is a flowchart illustrating an example of current control by the control unit 60.

First, the power control unit 20 applies a voltage Va to one electrode of the reduction electrode 120 and the oxygen evolving electrode 130 so as to produce an electric difference with respect to other electrode thereof (S10). At this time, the applied voltage should be changed in order to control a current value, and is not particularly limited, but it is preferable to be from 1.4 V to 2.2 V.

Next, the concentration C of the aromatic compound in the organic liquid to be supplied to the reduction electrode 120 is measured by the concentration measurement unit 34 (S20).

Next, based on the concentration C of the aromatic compound measured by the concentration measurement unit 34, the maximum current value Imax (C) is set (S30). The maximum current value Imax (C) may be properly determined according to the concentration C of the aromatic compound with reference to the corresponding relation between the concentration C of the aromatic compound and the maximum current value Imax (C), and where the corresponding relation is stored in the memory such as a ROM in advance. In addition, the corresponding relation of the maximum current value Imax (C) and the concentration C of the aromatic compound is prepared to the different conditions (80%, 85%, 90%, 95%, and the like) that are Faraday efficiency of 80% or more, and may be preferable such that the condition of Faraday efficiency to be desired by a user is properly set. In addition, it is preferable that the current value I be Imax or less, and also larger value within the possible range. For example, the current value I may be controlled to be larger than the predetermined value, that is, at least 0.7 times of Imax, preferably, 0.8 times, and more preferably 0.9 times or more. For this reason, while Faraday efficiency is maintained to be high, excessive extension of the time required for electricity can be inhibited.

Next, the current value I flowing through the reduction electrode 120 is detected by the current detection unit 113 (S40).

Next, it is determined whether or not the detected current value I satisfies the relation of I≤Imax (C) (S50). When the current value I satisfies the relation of I≤Imax (C), S50 progresses to "yes". After counting the elapse of the predetermined time (for example, 60 seconds) by a timer (S60), the process goes back to the process of S20 or below. On the other hand, when the current value I does not satisfy the relation of I≤Imax (C), the voltage Va is adjusted (S70). Here, the current value I is decreased by decreasing the voltage Va by a fixed quantity. The degree of the decrease of the voltage Va is not particularly limited, but for example, 10 mV. After decreasing the voltage Va, the process goes back to S40 or below, and thus, the current value I is re-detected.

According to the electrochemical reduction device 10 described above, by properly maintaining the current value I flowing through the reduction electrode 120 to be the maximum current value Imax (C) or less that allows to obtain Faraday efficiency of 80% or more according to the concentration C of the aromatic compound, while Faraday efficiency is maintained to be high, that is, 80% or more, the electrode reaction can be progressed within the range in which the nucleus-hydrogenation reaction of the aromatic compound is dominant. Especially, by controlling the current value I as described above according the concentration C of the aromatic compound that is changed hour by hour in a condition of slowly decreasing the concentration C of the aromatic compound, while preventing Faraday efficiency from being smaller than the desired value, the electrode reaction can be progressed.

Embodiment 2

Figure 6:
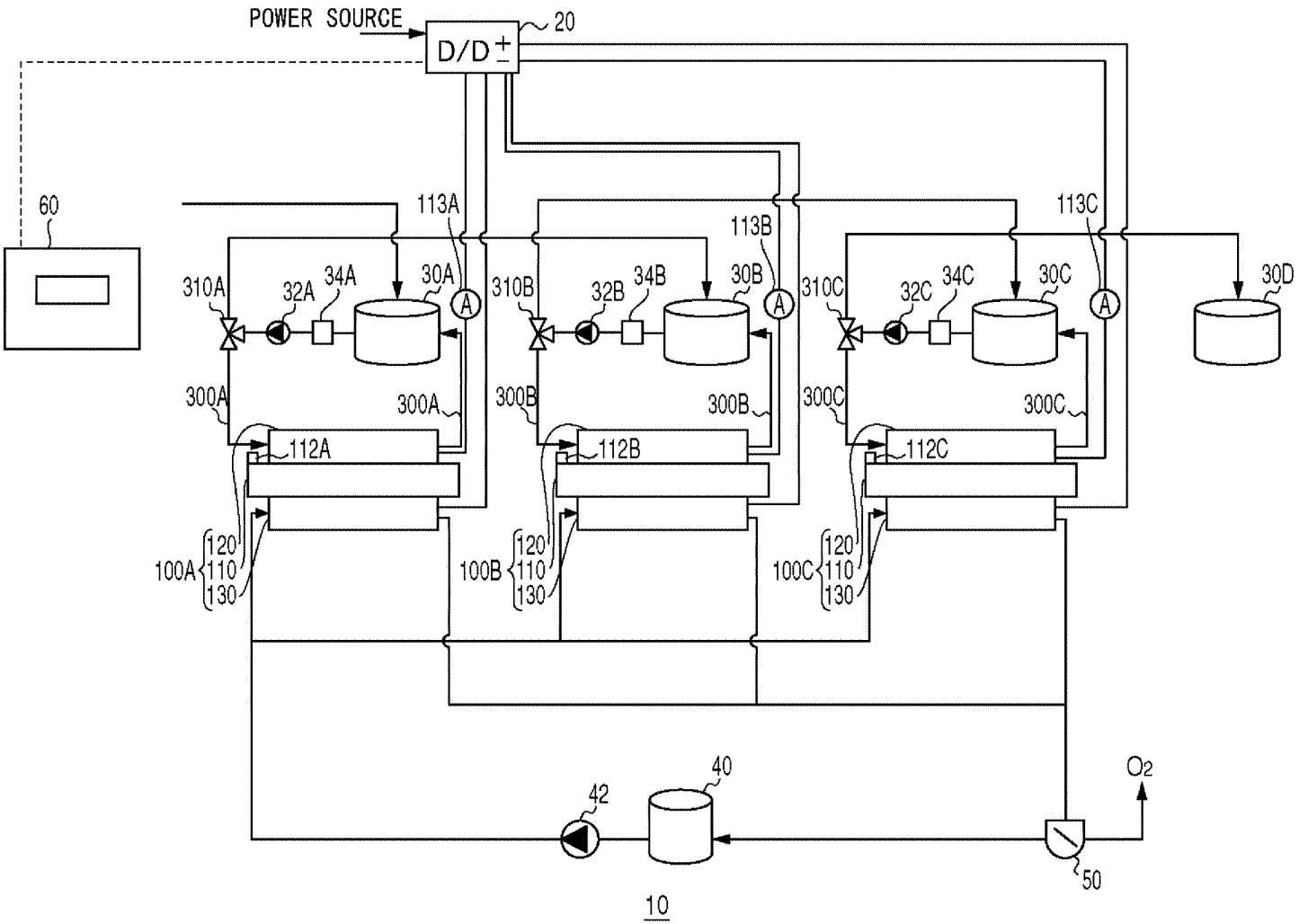
FIG. 6 is a schematic diagram illustrating the general configuration of an electrochemical reduction device according to an embodiment 2.

FIG. 6 is a schematic diagram illustrating the general configuration of an electrochemical reduction device according to an embodiment 2. As illustrated in FIG. 6, the electrochemical reduction device 10 includes electrode units 100A, 100B, and 100C, which are each independent. In the present embodiment, the number N of the electrode units 100 is three, but the number N may be any number as long as it is equal to or more than two. The configuration of each electrode unit 100 is similar to the configuration in the embodiment 1, and the explanation thereof will not be appropriately provided. In FIG. 6, the electrode unit 100 is simplified for illustration, and the liquid diffusion layers 140*a* and 140*b* and the separators 150*a* and 150*b* illustrated in FIG. 2 are not illustrated.

In the present embodiment, the power control unit 20 applies, each independently, a voltage Va (A), a voltage Va (B), and a voltage Va (C) to the corresponding electrode of the oxygen evolving electrode 130 and the reduction electrode 120 of each of the electrode units 100 so as to produce an electric difference with respect to other electrode thereof. In addition, the control unit 60 sets the maximum current value Imax, each independently, for the respective electrode units 100. In addition, the reference electrode input terminals of the power control units 20 that are provided on the respective electrode units 100 are connected to the reference electrode 112A, the reference electrode 112B, and the reference electrode 112C, which are each provided on electrolyte membranes 110 of the respective electrode units 100. The output of the reference electrode input terminal of the power control unit 20 is controlled by the control unit 60 to be desired potentials of the oxygen evolving electrode 130 and the reduction electrode 120 based on the potentials of the respective reference electrodes 112.

Circulation pathways 300A, 300B, and 300C via the reduction electrodes of the electrode units 100 and organic material storage tanks are provided at the respective electrode units 100. The circulation pathways 300B and 300C are the same as the circulation pathway 300A, and thus the circulation pathway 300A will be described with illustration below, and the description of the circulation pathways 300B and 300C will not be provided appropriately. The circulation pathway 300A is a pipeline for circulating the aromatic compound between the organic material storage tank 30A and the reduction electrode 120 of the electrode unit 100A. A concentration measurement unit 34A, a first liquid supply device 32A, and a three-way valve 310A are provided in order on the downstream side of the organic material storage tank 30A.

The three-way valve 310A can switch between a pathway from the first liquid supply device 32A to the reduction electrode of the electrode unit 100A and a pathway from the first liquid supply device 32A to the organic material storage tank 30B. A three-way valve 310B provided on the circulation pathway 300B can switch between a pathway from the first liquid supply device 32B to the reduction electrode 120 of the electrode unit 100B and a pathway from the first liquid supply device 32B to the organic material storage tank 30C. In addition, a three-way valve 310C provided on the circulation pathway 300C can switch between a pathway from the first liquid supply device 32C to the reduction electrode of the electrode unit 100C and a pathway from the first liquid supply device 32C to the organic material storage tank 30D. The organic material storage tank 30D stores a final product treated by an electrode unit assembly 200. In the present embodiment, the three-way valves 310A to 310C are solenoid valves controlled by the control unit 60.

A circulation pathway for water is provided between the water storage tank 40 and the oxygen evolving electrode 130 of each electrode unit 100. Water stored in the water storage tank 40 is supplied to the oxygen evolving electrode 130 of each electrode unit 100 by a second liquid supply device 42. Specifically, a pipeline that comprises the circulation pathway for water is branched on the downstream side of the second liquid supply device 42, and distributes and supplies water to the oxygen evolving electrode 130 of each electrode unit 100. In each electrode unit 100, unreacted water merges into the pipeline that communicates with the water storage tank 40, then passes through the pipeline, and is stored in the water storage tank 40.

As the embodiment 1, the respective reference electrodes 112A, 112B, and 112C are provided on the electrolyte membrane 110 of each electrode unit 100 so as to contact with the electrolyte membrane 110 in an area spaced apart from the reduction electrode 120 and the oxygen evolving electrode 130.

The current flowing through the reduction electrode 120 of the electrode unit 100A is measured by a current detection unit 113A, and the signal relating to the obtained current is sent to the control unit 60. Similarly, the respective currents flowing through the reduction electrodes 120 of the electrode units 100B and 100C are measured by the current detection units 113B and 113C, and then the signals relating to the obtained currents are sent to the control unit 60.

The benzene ring of the aromatic compound that is supplied to the organic material storage tank 30A is hydrogenated at the reduction electrode of the electrode unit 100A during being circulated in the circulation pathway 300A by the first liquid supply device 32A, and thus gradually becomes a hydride in which a benzene ring is hydrogenated. Therefore, the concentration of the aromatic compound in an organic liquid including the aromatic compound and the hydride is decreased. The control unit 60 controls the three-way valve 310A such that the organic liquid is circulated in the circulation pathway 300A until the concentration of the aromatic compound measured by the concentration measurement unit 34A becomes a predetermined concentration lower limit value. For example, when the aromatic compound of a 100% concentration is supplied to the first liquid supply device 32A as a raw material, the circulation pathway 300A is formed until the concentration becomes 50%. In this time, the control unit 60 controls the power control unit 20 so as to be I≤Imax (C) according to the concentration C of the aromatic compound measured by the concentration measurement unit 34A. The mode of the control of the current value I by the control unit 60 is the same as an embodiment 1.

Next, when the concentration of the aromatic compound measured by the concentration measurement unit 34A reaches a predetermined concentration lower limit value, the control unit 60 controls the three-way valve 310A so as to open a pathway from the first liquid supply device 32A to the organic material storage tank 30B. For this reason, the organic liquid in the circulation pathway 300A is stored in the organic material storage tank 30B.

The benzene ring of the aromatic compound included in the organic liquid supplied to the organic material storage tank 30B is hydrogenated at the reduction electrode of the electrode unit 100B during being circulated in the circulation pathway 300B by the first liquid supply device 32B, and thus the concentration of the aromatic compound in the organic liquid is gradually decreased. The control unit 60 controls the three-way valve 310B such that the organic liquid is circulated in the circulation pathway 300B until the concentration of the aromatic compound measured by the concentration measurement unit 34B becomes a predetermined concentration lower limit value. For example, when the aromatic compound of a 50% concentration is supplied to the first liquid supply device 32B, the circulation pathway 300B is formed until the concentration becomes 20%. In this time, the control unit 60 controls the power control unit 20 so as to be I≤Imax (C) according to the concentration C of the aromatic compound measured by the concentration measurement unit 34B. The mode of the control of the current value I by the control unit 60 is the same as an embodiment 1.

Next, when the concentration of the aromatic compound measured by the concentration measurement unit 34B reaches a predetermined concentration lower limit value, the control unit 60 controls the three-way valve 310B so as to open a pathway from the first liquid supply device 32B to the organic material storage tank 30C. For this reason, the organic liquid in the circulation pathway 300B is stored in the organic material storage tank 30C.

The benzene ring of the aromatic compound included in the organic liquid supplied to the organic material storage tank 30C is hydrogenated at the reduction electrode of the electrode unit 100C during being circulated in the circulation pathway 300C by the first liquid supply device 32C, and thus the concentration of the aromatic compound in the organic liquid is gradually decreased. The control unit 60 controls the three-way valve 310C such that the organic liquid is circulated in the circulation pathway 300C until the concentration of the aromatic compound measured by the concentration measurement unit 34C becomes a predetermined concentration lower limit value. For example, when the aromatic compound of a 20% concentration is supplied to the first liquid supply device 32C, the circulation pathway 300C is formed until the concentration becomes 5%. In this time, the control unit 60 controls the power control unit 20 so as to be I≤Imax (C) according to the concentration C of the aromatic compound measured by the concentration measurement unit 34C. The mode of the control of the current value I by the control unit 60 is the same as an embodiment 1.

Next, when the concentration of the aromatic compound measured by the concentration measurement unit 34C reaches a predetermined concentration lower limit value, the control unit 60 controls the three-way valve 310C so as to open a pathway from the first liquid supply device 32C to the organic material storage tank 30D. For this reason, the organic liquid in the circulation pathway 300C is stored in the organic material storage tank 30D. In this way, the benzene ring of the aromatic compound that is supplied as a raw material is hydrogenated by passing through the reduction electrode of the electrode unit 100A, the reduction electrode of the electrode unit 100B, and the reduction electrode of the electrode unit 100C in order, and then stored in the organic material storage tank 30D.

According to the electrochemical reduction device 10 as described above, while assuring Faraday efficiency of 80% or more for each of the electrode units, and the hydrogenations of at least one benzene ring of the aromatic compounds having different concentrations can be performed in the electrode unit 100A, the electrode unit 100B, and the electrode unit 100C at the same time. Therefore, as compared with the case of performing hydrogenation of at least one benzene ring of the aromatic compound using single electrode unit, it is possible to largely increase the amount of the aromatic compounds that can be treated per unit time.

The present invention is not limited to the above-mentioned embodiments, and various modifications, such as a design change, can be added thereto based on knowledge of those skilled in the art, and any embodiment to which such modifications are added can also be included in the scope of the present invention.

In the above-described embodiments, the reduction electrode 120 contains an ionomer having protonic conductivity, but the reduction electrode 120 may contain an ionomer having hydroxy ion conductivity.

In addition, in the above-described embodiment 2, the three-way valves 310A to 310C switch between the circulation pathways for the electrode units 100A to 100C and a supply pathway into the electrode unit 100 of the downstream side, but as the concentration of the aromatic compound measured by each concentration measurement unit 34 is made close to the concentration lower limit value set to each electrode unit 100, the opening of each three-way valve 310 may be adjusted such that the distribution of the supply pathway into the electrode unit 100 of the downstream side becomes larger as compared with the distribution of the circulation pathway.

In addition, the circulation pathway for water described in the above-described embodiment 2 is formed in a parallel-type pathway to distribute from the water storage tank 40 to each electrode unit 100, but may be formed in a straightway-type pathway in which water supplied from the water storage tank 40 passes through the oxygen evolving electrodes 130 of the electrode units 100A to 100C in order.

The invention claimed is:

1. An electrochemical reduction device comprising:

an electrode unit being configured by including an electrolyte membrane having ionic conductivity, a reduction electrode that is provided on one side of the electrolyte membrane and includes an reduction catalyst for hydrogenating a benzene ring of an aromatic compound, and an oxygen evolving electrode that is provided on the other side of the electrolyte membrane;

a power control unit that applies voltage Va to one electrode of the reduction electrode and the oxygen evolving electrode so as to produce an electric difference with respect to other electrode thereof;

a concentration measurement unit that measures a concentration of the aromatic compound supplied to the reduction electrode; and a control unit that controls the power control unit such that a current value I flowing through the reduction electrode and the oxygen evolving electrode satisfies a relation of $I \leq Imax\ (C)$ with respect to a maximum current value Imax (C) defined according to the concentration C of the aromatic compound obtained by the concentration measurement unit;

wherein the maximum current value Imax (C) is defined such that Faraday efficiency becomes a predetermined value or more.

2. The electrochemical reduction device according to claim 1, wherein the maximum current value Imax (C) is set to be low as the concentration C of the aromatic compound is low.

3. The electrochemical reduction device according to claim 1, wherein the predetermined value is 80%.

4. A method for manufacturing a hydride of an aromatic compound, the method comprising:

by using the electrochemical reduction device according to claim 1, introducing an aromatic compound to the reduction electrode side of the electrode unit; and hydrogenating a benzene ring of the aromatic compound introduced to the reduction electrode side by flowing water or a humidified gas to the oxygen evolving electrode side.

5. The method for manufacturing a hydride of an aromatic compound according to claim 4, wherein the aromatic compound introduced into the reduction electrode side is introduced in a liquid state for a reaction temperature to the reduction electrode side.

* * * * *